US008333576B2

(12) United States Patent
Rytlewski et al.

(10) Patent No.: US 8,333,576 B2
(45) Date of Patent: Dec. 18, 2012

(54) POWER STEERING PUMP HAVING INTAKE CHANNELS WITH ENHANCED FLOW CHARACTERISTICS AND/OR A PRESSURE BALANCING FLUID COMMUNICATION CHANNEL

(75) Inventors: Thomas C. Rytlewski, Auburn, MI (US); Kenneth P. Webber, Jr., Saint Charles, MI (US); Rick L. Lincoln, Linwood, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 756 days.

(21) Appl. No.: 12/412,451

(22) Filed: Mar. 27, 2009

(65) Prior Publication Data

US 2009/0257901 A1 Oct. 15, 2009

Related U.S. Application Data

(60) Provisional application No. 61/124,096, filed on Apr. 12, 2008, provisional application No. 61/124,095, filed on Apr. 12, 2008.

(51) Int. Cl.
*F03C 2/00* (2006.01)
*F03C 4/00* (2006.01)
*F04C 2/00* (2006.01)

(52) U.S. Cl. ..... 418/133; 418/181; 418/259; 417/310

(58) Field of Classification Search ..... 418/132–134, 418/181, 259, 72, 75–78; 417/310
See application file for complete search history.

(56) References Cited

U.S. PATENT DOCUMENTS

| | | | |
|---|---|---|---|
| 2,284,146 | A | 5/1942 | Herman |
| 2,377,556 | A | 6/1945 | Jeannin |
| 2,401,567 | A | 6/1946 | Jeannin |
| 2,426,100 | A | 8/1947 | Holden et al. |
| 2,463,299 | A | 3/1949 | Nixon |
| 2,511,573 | A | 6/1950 | Finlayson et al. |
| 2,570,411 | A | 10/1951 | Vickers |
| 2,641,193 | A | 6/1953 | Klessig |
| 2,739,539 | A | 3/1956 | Gardiner |
| 2,763,216 | A | 9/1956 | Klessig |
| 2,766,700 | A | 10/1956 | Klessig |
| 2,821,143 | A | 1/1958 | Pettibone |
| 2,962,973 | A | 12/1960 | Pettibone |

(Continued)

FOREIGN PATENT DOCUMENTS

JP 59180088 A * 10/1984 ..... 418/133

*Primary Examiner* — Theresa Trieu
(74) *Attorney, Agent, or Firm* — Cantor Colburn LLP

(57) ABSTRACT

A power steering pump includes, an intake flow channel defined by a first surface; a chamber into which fluid is received; and a plate disposed between the first surface and the chamber. An opening having opposed terminal ends extends through the plate. The intake flow channel is in fluid communication with the chamber through the plate opening and is configured to direct fluid flow through the plate opening into the chamber at a location intermediate and spaced from the terminal ends. The intake flow channel is defined by a bottom surface and a sloped surface extending from the bottom surface toward the plate. The flow channel has a transition zone through which the bottom surface and the sloped surface are joined. The transition zone is located at a position along the intake flow channel at which it and one of the plate opening terminal ends are approximately superposed.

14 Claims, 14 Drawing Sheets

U.S. PATENT DOCUMENTS

| | | | | | |
|---|---|---|---|---|---|
| 2,967,488 | A | | 1/1961 | Gardiner | |
| 3,046,897 | A | | 7/1962 | Badenoch | |
| 3,046,898 | A | | 7/1962 | Badenoch et al. | |
| 4,406,599 | A | | 9/1983 | Stephan | |
| 4,637,782 | A | | 1/1987 | Teubler et al. | |
| 4,681,517 | A | | 7/1987 | Schulz et al. | |
| 4,757,743 | A | | 7/1988 | Tovey | |
| 4,770,612 | A | | 9/1988 | Teubler | |
| 4,925,372 | A | | 5/1990 | Hansen | |
| 5,017,086 | A | | 5/1991 | Hansen | |
| 5,046,933 | A | * | 9/1991 | Haga et al. | 418/133 |
| 5,051,065 | A | | 9/1991 | Hansen | |
| 5,064,362 | A | | 11/1991 | Hansen | |
| 5,171,131 | A | | 12/1992 | Niemiec | |
| 5,183,392 | A | | 2/1993 | Hansen | |
| 5,201,878 | A | * | 4/1993 | Abe et al. | 418/133 |
| 5,266,018 | A | | 11/1993 | Niemiec | |
| 5,380,178 | A | | 1/1995 | Noah | |
| 5,795,142 | A | | 8/1998 | Merz et al. | |
| 5,876,194 | A | | 3/1999 | Suelter | |
| 5,975,868 | A | | 11/1999 | Agner | |
| 6,139,285 | A | | 10/2000 | Uchida et al. | |
| 6,497,557 | B2 | | 12/2002 | Aden et al. | |
| 6,544,021 | B2 | | 4/2003 | Watanabe et al. | |
| 6,896,500 | B2 | * | 5/2005 | Ike et al. | 418/171 |
| 7,059,838 | B2 | | 6/2006 | Draskovits et al. | |
| 7,575,420 | B2 | * | 8/2009 | Ide et al. | 417/310 |

* cited by examiner

POWER STEERING PUMP HAVING INTAKE CHANNELS WITH ENHANCED FLOW CHARACTERISTICS AND/OR A PRESSURE BALANCING FLUID COMMUNICATION CHANNEL

CROSS REFERENCE TO RELATED APPLICATIONS

The present application claims priority to U.S. Provisional Patent Applications Ser. Nos. 61/124,096 and 61/124,095, both filed Apr. 12, 2008, the disclosures of which are both hereby expressly incorporated by reference.

BACKGROUND OF THE INVENTION

1. Field of the Invention

The present invention relates to hydraulic pumps and, more particularly, to hydraulic pumps suitable for use in a vehicular power steering application.

2. Description of the Related Art

Many modern vehicles have hydraulic power assisted steering systems having a power steering pump for circulating the hydraulic fluid within the system. The power steering circuit typically includes a reservoir from which hydraulic fluid is fed to the pump. Fluid discharged by the pump is used to operate a steering gear and then returns to the reservoir. The reservoir not only collects hydraulic fluid for intake by the pump but also typically conditions the hydraulic fluid by de-aerating and filtering the hydraulic fluid. The reservoir may also act as a thermal sink and cool the fluid. Fluid from the reservoir is fed to the pump and the cycle is repeated. The pump will often generate more fluid flow than is necessary for operation of the steering gear and the pump will typically include a flow control valve that re-circulates excess flow from the discharge to the intake channels of the pump.

FIG. 1 presents a simplified schematic diagram of a power steering system 20 for a vehicle. Power steering system 20 includes a pump 22 which discharges fluid into a hydraulic line 24 leading to steering gear 26. Hydraulic fluid flows through the circuit from steering gear 26 to reservoir 28 where it is de-aerated and filtered prior to returning to pump 22. A flow control valve 30 diverts fluid from discharge line 24 of pump 22 to intake line 32 of pump 22 when pump 22 is producing excessive fluid flow. Although flow control valve 30 is presented as an external valve in the schematic depiction shown in FIG. 1, valve 30 is physically located within the housing of pump 22.

For many vehicles, the power steering pump shaft typically has a pulley that is driven by a belt that is also coupled to a pulley on the vehicle crankshaft. It is also known to drive the power steering pump by an electrical motor.

A variety of different types of power steering pumps are known in the art and four general types of pumps that can be used for such power steering pumps include vane, roller, slipper and gear pumps. Vane-type steering pumps are in common use in contemporary vehicles and examples of vane-type steering pumps are disclosed in U.S. Pat. No. 6,913,446 B2 issued to Nissen et al.; U.S. Pat. No. 6,899,528 B2 issued to Youngpeter et al.; U.S. Pat. No. 6,857,863 B1 issued to Modrzejewski et al.; and U.S. Pat. No. 6,666,670 B1 issued to Hartman et al., the disclosures of which are hereby incorporated herein by reference.

FIG. 2 is a simplified exploded view of pump 22 which is a high flow vane pump. Pump 22 includes a housing 34 which in the illustrated embodiment is a cast aluminum housing or other suitable material. A drive shaft 36 extends through housing 34 and thrust plate 38 into interior housing volume 40. A rotor 42 is mounted on shaft 36 within housing volume 40 and includes slots 44 in which vanes 46 are located. A pump rotating group including camming ring 48 is schematically depicted in FIG. 3 and is located within housing volume 40. Camming ring 48 surrounds rotor 42, vanes 46 and chambers 50. (Camming ring 48 is not shown in FIG. 2.) An end plate assembly 52 seals the end of housing volume 40 opposite thrust plate 38 and is secured within housing 34 by a retaining ring 54 or other suitable means. The general operating principles of vane-type pumps such as pump 22 are well known to those having ordinary skill in the art.

FIGS. 4 and 5 illustrate prior art pump 22*a*, a known, commercialized embodiment of vane-type pump 22. In pump 22*a*, thrust plate 38 has first and second openings 56, 58 through which hydraulic fluid flows into an intake chamber. Openings 56, 58 are oblong, and each has opposed terminal ends 60. Relative to each opening 56, 58, one terminal end 60 is downstream of the other terminal end 60 relative to fluid flowing through the intake flow channel. It is noted that vanes 46 subdivide that portion of housing volume 40 within camming ring 48 into separate chambers 50 and that first and second thrust plate openings 56, 58 are in communication with two separate chambers 50. When these separate chambers 50 are in communication with openings 56, 58 they function as intake chambers, taking in hydraulic fluid. As shaft 36 rotates rotor 42 and vanes 46, the chambers 50 which had just functioned as intake chambers receiving fluid flowing through openings 56, 58, rotate out of communication with openings 56, 58 and begin to function as discharge chambers. After rotating out of communication with openings 56, 58, chambers 50 are rotated into communication with discharge ports and become progressively smaller thereby increasing the pressure of the fluid and discharging the fluid through the discharge ports.

Pump 22*a* is configured such that fluid entering a chamber 50 through one of openings 56, 58 is discharged through a discharge port after rotation through an angle of approximately 90 degrees about the axis of shaft 36.

Thrust plate 38 is seated against surface 62 formed by housing 34 and which is best seen in FIG. 5. An intake flow channel 64 is formed in surface 62 and has a generally V-shaped configuration when viewed along the rotational axis of shaft 36 as depicted in FIG. 5. Intake line 32 of pump 22 feeds into flow channel 64 through an opening 66 near the apex of the V-shape of channel 64. The fluid flowing into channel 64 through opening 66 is then divided into two flow channels 68, 70 which form the two separate legs of V-shaped channel 64. Intake channels 68, 70 respectively lead to terminal areas 72, 74 which are in fluid communication with openings 56, 58 in thrust plate 38. Terminal areas 72, 74 of intake channels 68, 70 each have a shape and size that generally conforms to their respective opening 56, 58 in thrust plate 38 such that substantially all of the area of an opening 56, 58 is positioned above or over the respective terminal area 72, 74. In operation, fluid flows from opening 66 through channels 68, 70 and then from terminal areas 72, 74 through openings 56, 58 in thrust plate 38 into separate chambers 50.

While many adequate steering pump designs such as pump 22*a* are known in the art, a steering pump having improved fluid flow and/or pressure balancing characteristics, which reduce the variability and magnitude of pressures within the pump, and provide noise reduction, increased durability, and the opportunity for cost saving benefits, remains desirable.

SUMMARY OF THE INVENTION

The present invention provides a steering pump design which improves its internal fluid flow and/or pressure balancing characteristics and provides a more durable and quietly operating pump.

The present invention provides, in one form thereof, a power steering pump including a first surface, an intake flow channel defined by the first surface, a chamber into which fluid is received, and a plate disposed between the first surface and the chamber. The plate is provided with an opening extending therethrough, the plate opening having opposed terminal ends, one terminal end being downstream of the other relative to the flow of fluid through the intake flow channel. The intake flow channel is in fluid communication with the chamber through the plate opening, and the intake flow channel is configured to direct fluid flow through the plate opening into the chamber at a location intermediate and spaced from the terminal ends of the plate opening.

The present invention provides, in another form thereof, a power steering pump including a first surface, a pair of intake flow channels being defined by the first surface, a pair of chambers into which fluid is received, and a plate disposed between the first surface and the pair of chambers. The plate is provided with a pair of openings, each opening extending through the plate, and each of the pair of intake flow channels is in fluid communication with one of the chambers through one of the plate openings. The two intake flow channels are in fluid communication with each other through a pressure balancing fluid communication channel extending therebetween at areas in which the intake flow channels are respectively in fluid communication with one of the pair of plate openings. The pressure of fluid in the intake flow channels at these areas tending toward equalization through the pressure balancing fluid communication channel.

The present invention also provides, in another form thereof, a vane-type power steering pump including a first surface, a pair of chambers into which fluid is received, a thrust plate disposed between the first surface and the pair of chambers, and a pair of intake flow channels defined by the first surface and the thrust plate. The thrust plate is provided with a pair of openings, each opening extending therethrough, the thrust plate openings each having opposed terminal ends, one terminal end being downstream of the other relative to the flow of fluid through the respective intake flow channel. Each of the pair of intake flow channels is in fluid communication with one of the chambers through one of the thrust plate openings, and is configured to direct fluid flow through the respective thrust plate opening into the respective chamber at a location intermediate and spaced from the terminal ends of the thrust plate opening. The pump also includes a pressure balancing fluid communication channel extending between the pair of intake flow channels, the pair of intake flow channels being in fluid communication with each other through the pressure balancing fluid communication channel at areas in which the intake flow channels are respectively in fluid communication with one of the pair of thrust plate openings. The pressure of fluid in the intake flow channels at these areas tending toward equalization through the pressure balancing fluid communication channel.

BRIEF DESCRIPTION OF THE DRAWINGS

The above mentioned and other features of this invention, and the manner of attaining them, will become more apparent and the invention itself will be better understood by reference to the following description of embodiments of the invention taken in conjunction with the accompanying drawings, wherein.

Figure 1:
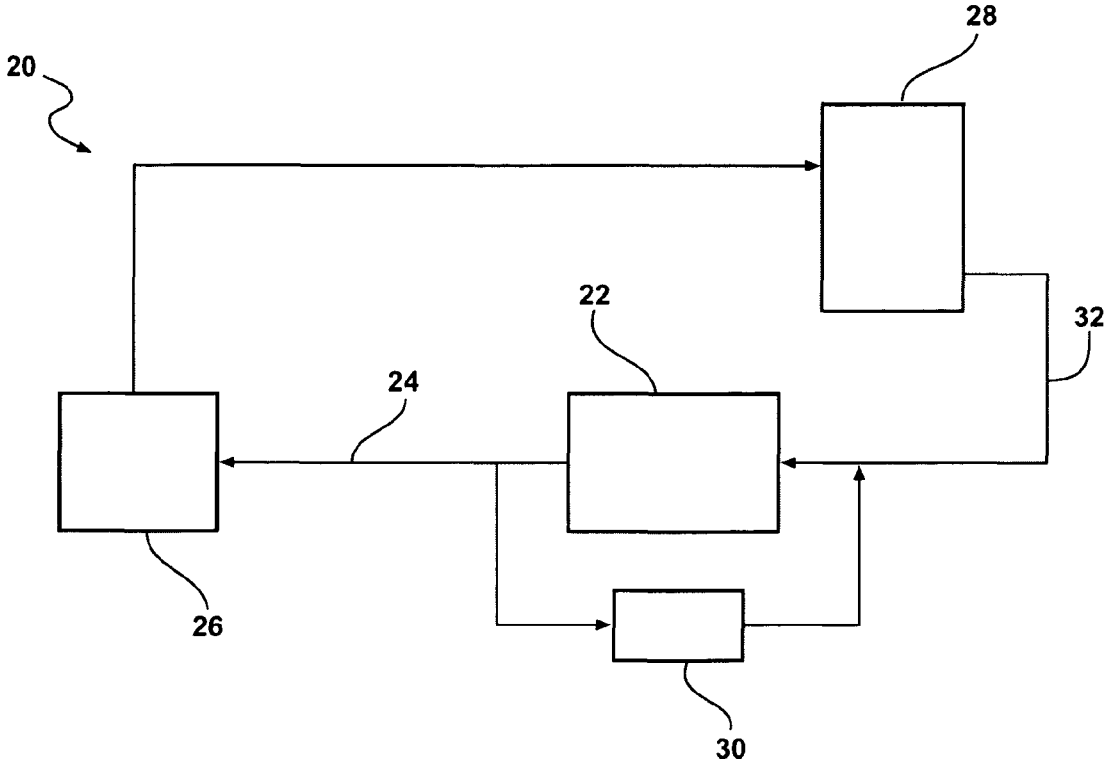
FIG. 1 PRIOR ART
FIG. 1 is a schematic view of a hydraulic steering circuit.
Figure 2:
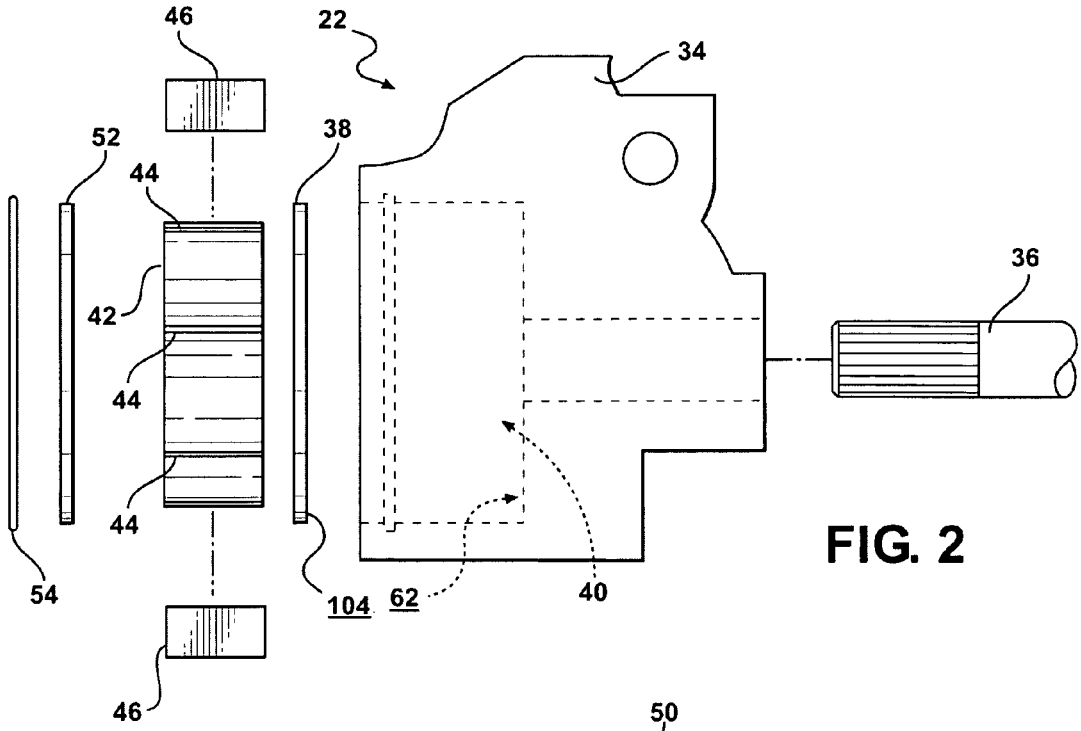
FIG. 2 is an exploded side view of a vane-type power steering pump.
Figure 3:
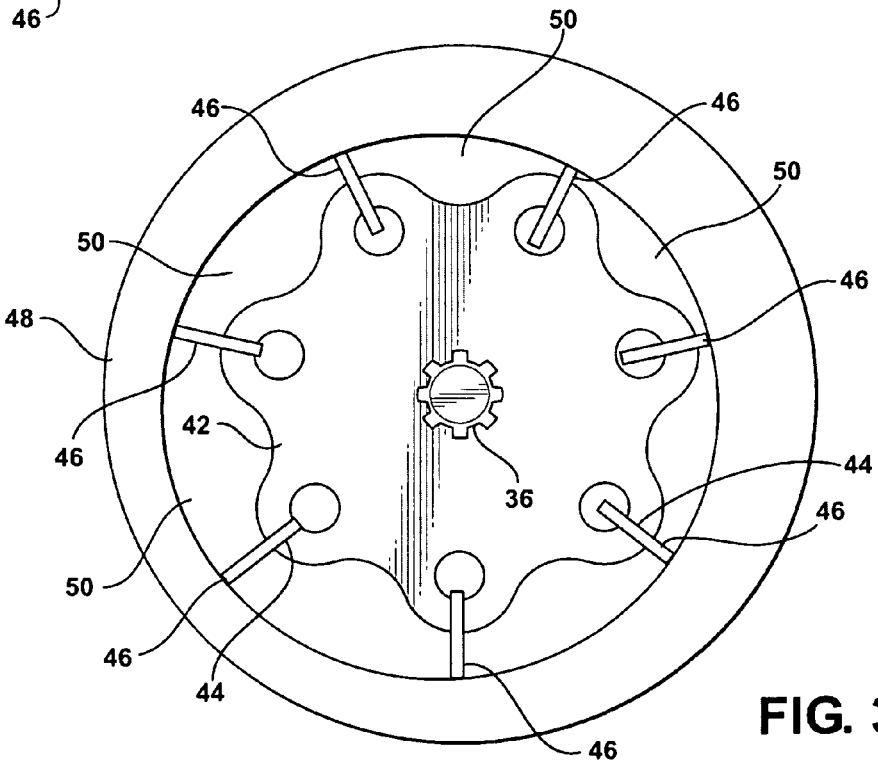
FIG. 3 is an end view of the rotating group of the pump of FIG. 2.

Corresponding reference characters indicate corresponding parts throughout the several views. While the invention is susceptible to various modifications and alternative forms, specific embodiments thereof are shown by way of example in the drawings and may herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Moreover, it is to be noted that the Figures are not necessarily drawn to scale and are necessarily not drawn to the same scale. In particular, the scale of some of the elements of the Figures is greatly exaggerated to emphasize characteristics of the elements. Elements shown in more than one Figure that may be similarly configured have been indicated using the same reference numerals.

DETAILED DESCRIPTION OF THE INVENTION

Figure 7:
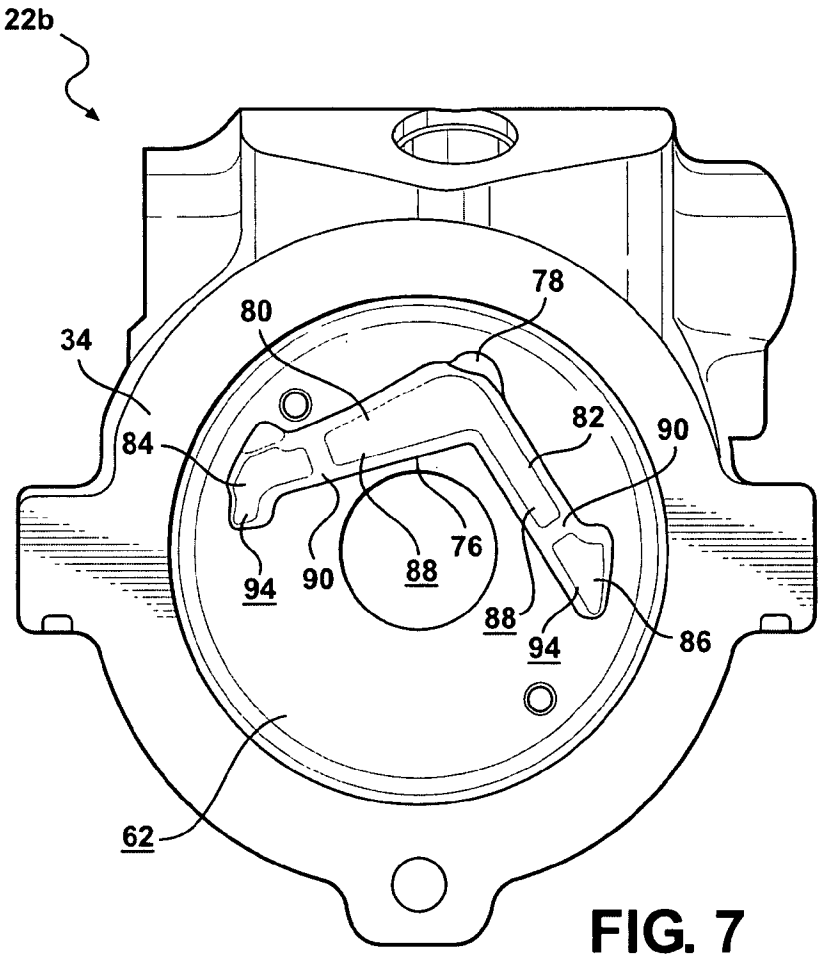
FIG. 7 is the same view as FIG. 6 but with the thrust plate removed.
Figure 6:
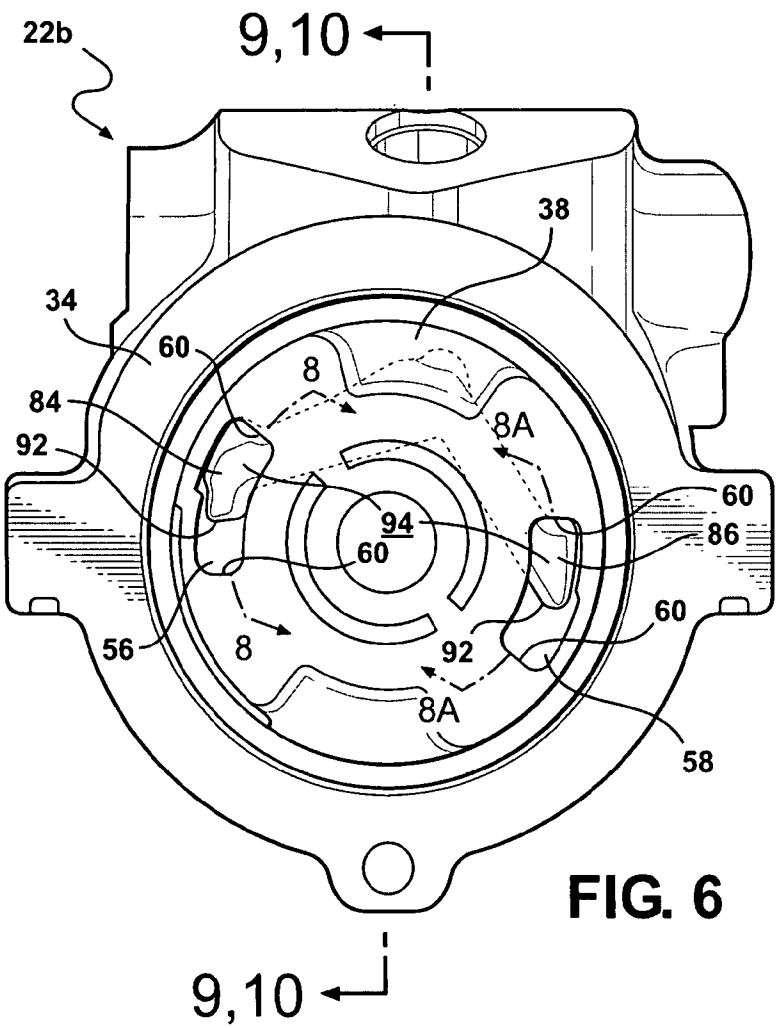
FIG. 6 is an end view of the interior housing volume of a first embodiment of a vane-type pump with the rotor removed and showing the thrust plate.

FIGS. 6 and 7 illustrate pump 22*b*, a first embodiment of pump 22 in accordance with the present invention. Pump 22*b* is substantially identical to pump 22*a* except for the configuration of the intake flow channel in surface 62. Intake flow channel 76 of pump 22*b* receives hydraulic fluid through opening 78. Channel 76 has a first channel leg 80 and a second channel leg 82 which include respective terminal area 84, 86 which is respectively positioned below or under an opening 56, 58 in thrust plate 38. Terminal areas 84, 86, however, do not conform to the shape of the overlying openings 56, 58 in thrust plate 38. Instead, terminal areas 84, 86 underlie approximately one half of openings 56, 58. Channels 80, 82 have a depth of approximately 10 mm where such channels 80, 82 underlie a solid portion of thrust plate 38. Beginning near the point at which channels 80, 82 begin to underlie openings 56, 58, the bottom surface 88 of channels 80, 82 begins to slope upwards or toward thrust plate 38. These transition zones are marked 90 and can be seen in FIG. 7. The bottom of channels 80, 82, from transition zones 90 to the terminal ends 92 of terminal areas 84, 86, forms an upwardly sloped surface 94. Substantially flat bottom surface 88 is joined to sloped surface 94 through transition zone 90. The slope of surface 94 in channel 80 forms a 36 degree angle with a line extending along bottom surface 88 upstream of transition zone 90 and parallel with thrust plate 38 as depicted by angle 96 in FIG. 8. The slope of surface 94 in channel 82 is similar and forms a 40 degree angle with a line extending along bottom surface 88 upstream of transition zone 90 and parallel with thrust plate 38 as depicted by angle 96 in FIG. 8A. Although specific channel geometry has been described herein, the present invention is not limited to this geometry and various other intake flow channels can be employed with the present invention.

Figure 8:
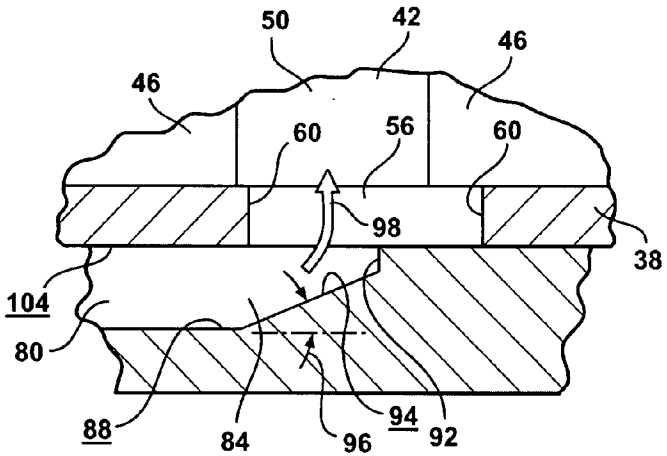
FIG. 8 is an enlarged, fragmentary view of a cross section taken along line 8-8 of FIG. 6, showing the intake flow channel, thrust plate and intake chamber.
Figure 8A:
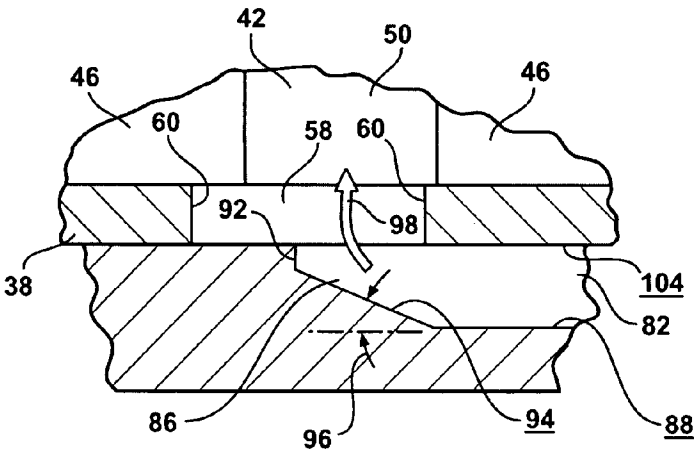
FIG. 8A is an enlarged, fragmentary view of a cross section taken along line 8A-8A of FIG. 6, showing the intake flow channel, thrust plate and intake chamber.

Terminal ends 92 of channels 80, 82 are located approximately midway between opposite terminal ends 60 of openings 56, 58 in thrust plate 38. Ends 60 of openings 56, 58 are located at approximately the same radial distance from the longitudinal axis of shaft 36 and at different angular positions about the shaft axis. The depth of channels 80, 82 is approximately 2 mm at channel ends 92. As shown in FIGS. 8 and 8A, the provision of an upwardly sloping channel bottom and the introduction of the fluid flow from the channel into the thrust plate opening 56, 58 at a point intermediate and spaced from opposed terminal ends 60 of each thrust plate opening 56, 58 directs the fluid flow, indicated by arrow 98 in FIGS. 8 and 8A, through the openings 56, 58 in a direction that is at an acute or obtuse angle (depending on how measured) to the plane of thrust plate 38. This relatively smooth redirection of the fluid flow from channels 80, 82 through openings 56, 58 reduces the turbulence of the fluid flow at this location in pump 22*b* in comparison to that of the fluid flow into chambers 50 from channels 68, 70 formed in surface 62 of prior art pump 22*a* which each lead to a terminal end surface oriented generally perpendicular to the fluid flow direction and defined by the terminal end 100 of each channel 68, 70 together with one terminal end 60 of its respective thrust plate opening.

Figure 9:
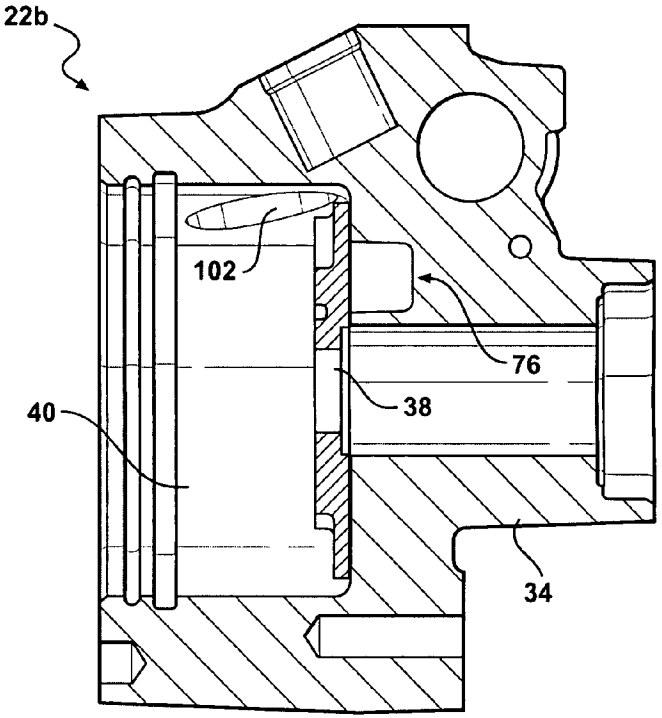
FIG. 9 is a cross sectional view taken along line 9-9 of FIG. 6.
Figure 10:
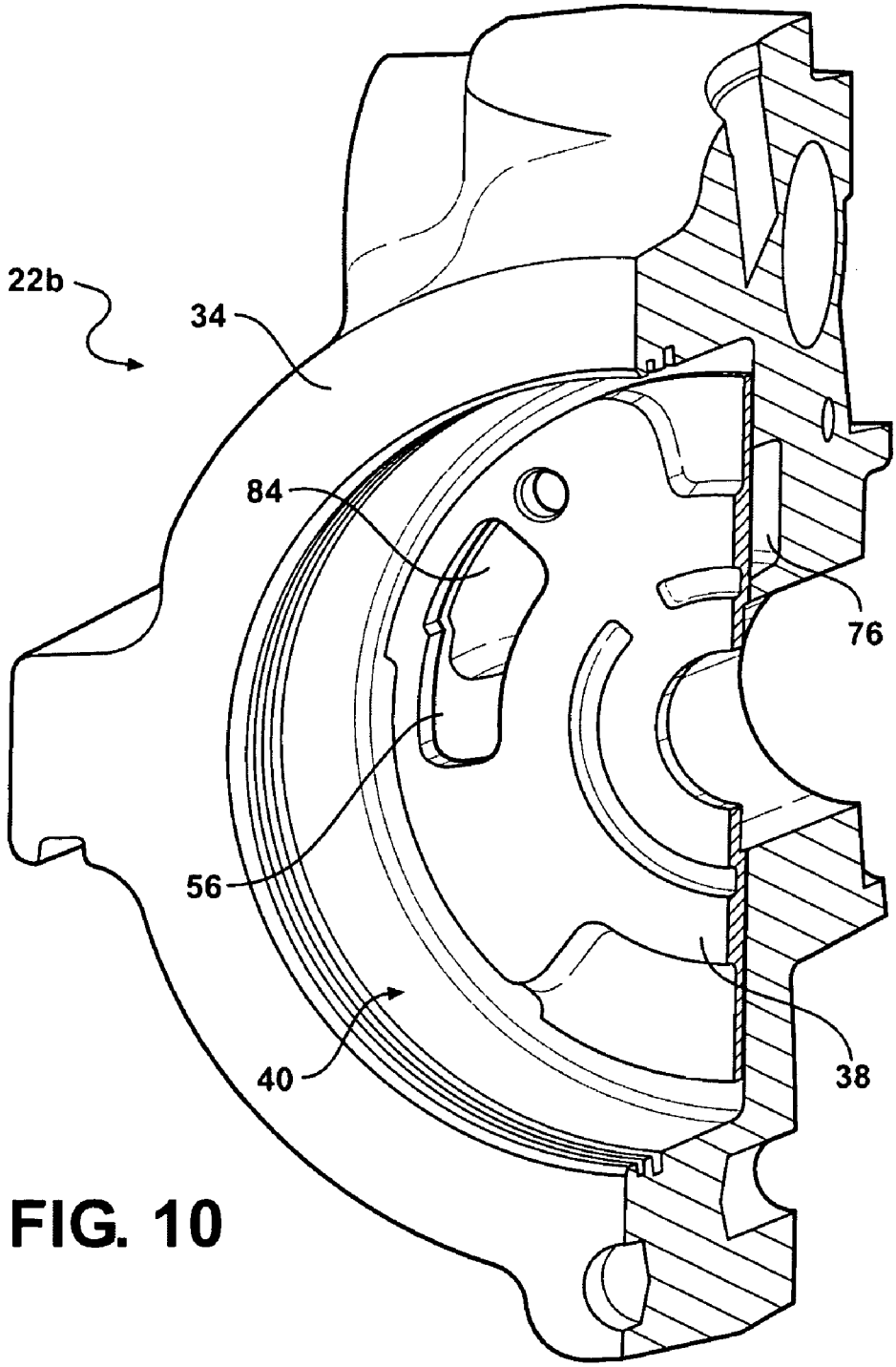
FIG. 10 is a perspective cross sectional view taken along line 10-10 of FIG. 6.

FIGS. 9 and 10 provide cross-sectional views of pump housing 34 and thrust plate 38. A discharge passage 102 in housing 34 can be seen in FIG. 9.

Figure 5:
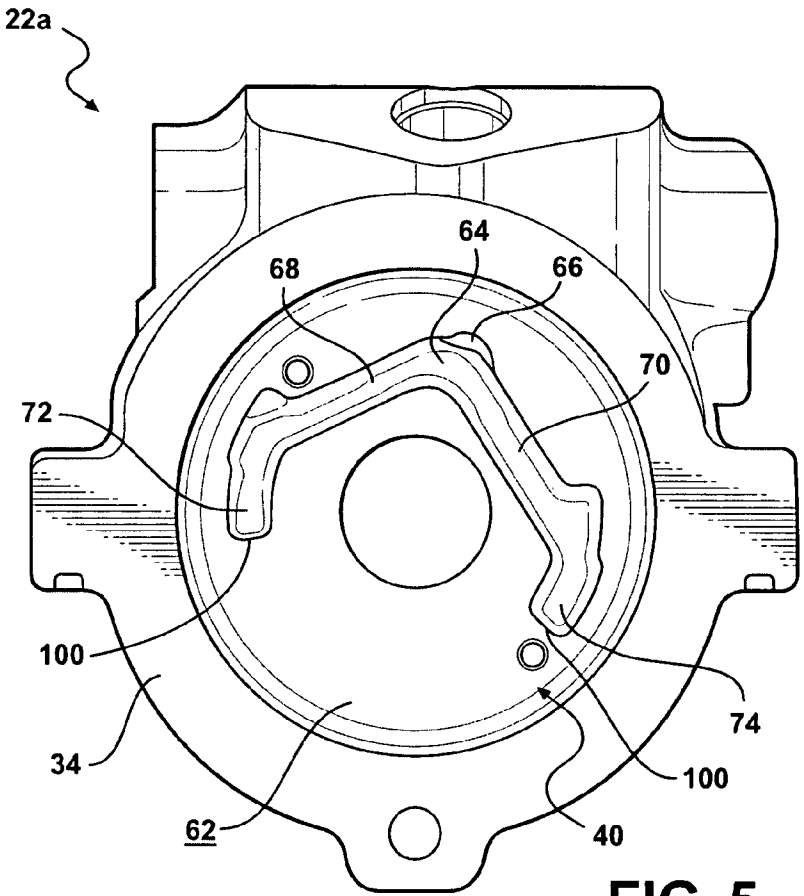
FIG. 5 PRIOR ART
FIG. 5 is the same view as FIG. 4 but with the thrust plate removed.
Figure 4:
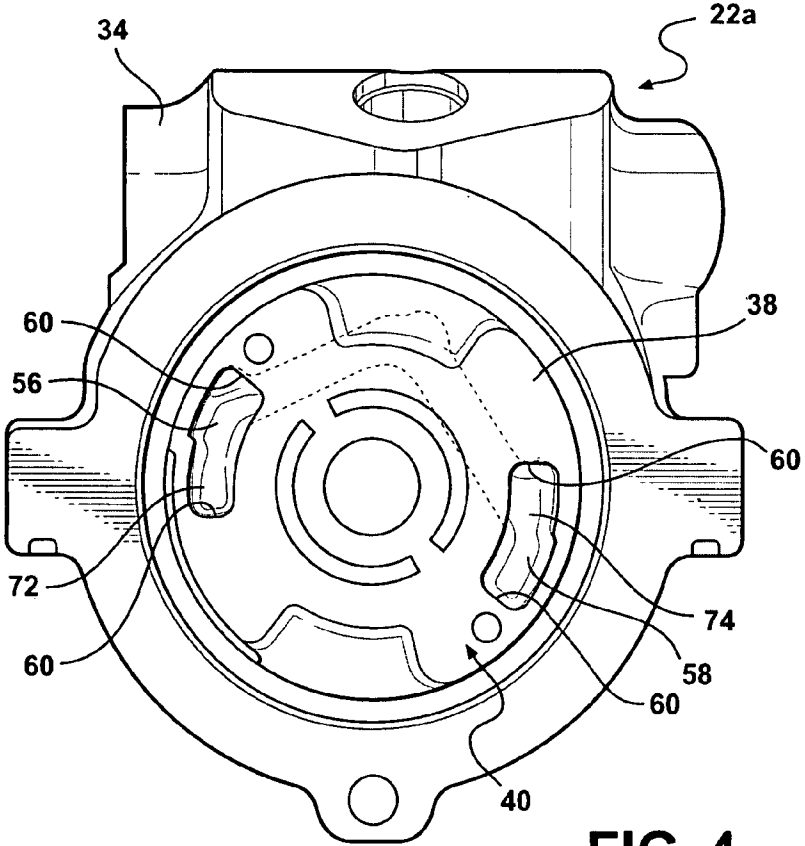
FIG. 4 PRIOR ART
FIG. 4 is an end view of the interior housing volume of a prior art vane-type pump with the rotor removed and showing the thrust plate.
Figure 11:
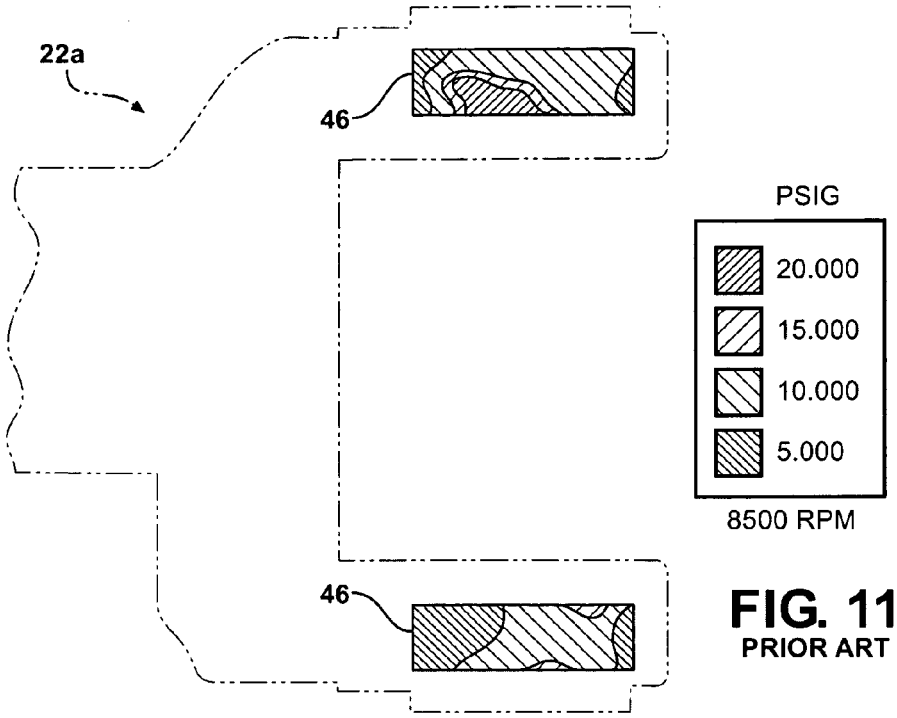
FIG. 11 PRIOR ART
FIG. 11 is a graphical representation of fluid pressure within the prior art pump of FIGS. 4 and 5 as computed by a flow model of the pump operating at 8500 rpm.

Flow model analyses of prior art pump 22*a* and first embodiment pump 22*b* were conducted at operating speeds of 8500 rpm and 3500 rpm and the fluid pressure values obtained by these analyses are presented in FIGS. 11 through 14. FIG. 11 displays the results of operating prior art pump 22*a* at a shaft speed of 8500 rpm while FIG. 12 displays the results of operating first embodiment pump 22*b* at the same shaft speed of 8500 rpm. The pressure in the intake fluid line immediately upstream of opening 66 (FIG. 5) in prior art pump 22*a* was approximately 19.5 pounds per square inch gauge (psig), whereas the pressure in the intake fluid line immediately upstream of opening 78 (FIG. 7) in first embodiment pump 22*b* was approximately 20.9 psig.

The vertically extending rectangle located at the right in each of FIGS. 11 through 14 is a legend and displays the shading or cross-hatching used to represent the different, indicated pressure values in psig. The horizontally extending shaded or cross-hatched rectangles located near the top and bottom of each of these Figures represent the fluid pressure on vanes 46 which face compression volumes or chambers 50 into which fluid is entering from thrust plate openings 56 (topmost rectangle) and 58 (bottommost rectangle).

Figure 12:
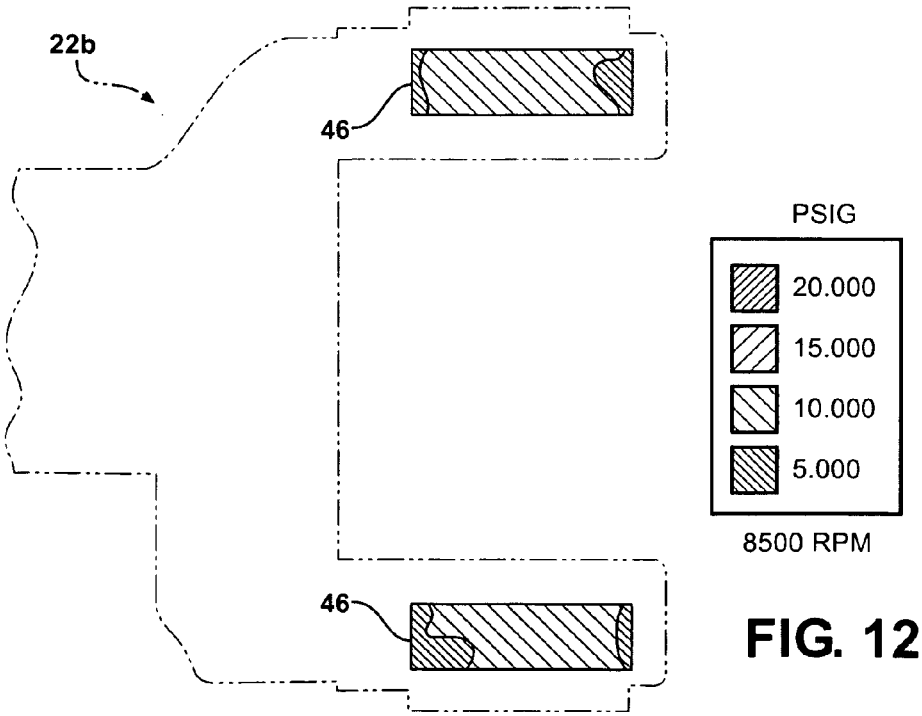
FIG. 12 is a graphical representation of fluid pressure within the first pump embodiment of FIGS. 6 and 7 as computed by a flow model of the pump operating at 8500 rpm.

As can be seen by a comparison of FIGS. 11 and 12, the range between highest and lowest pressures acting on vanes 46 is greater, and the distribution of different pressures acting on vanes 46 is more varied, with the intake flow channel configuration of prior art pump 22*a* (FIG. 11), than with the intake flow channel configuration of first embodiment pump 22*b* (FIG. 12).

Figure 13:
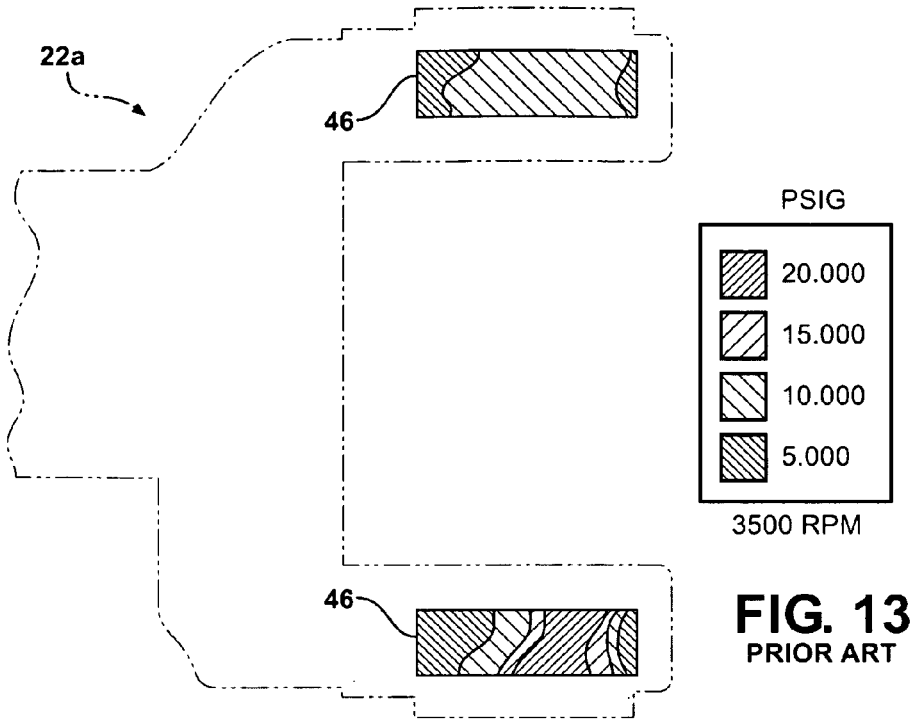
FIG. 13 PRIOR ART
FIG. 13 is a graphical representation of fluid pressure within the prior art pump of FIGS. 4 and 5 as computed by a flow model of the pump operating at 3500 rpm.
Figure 14:
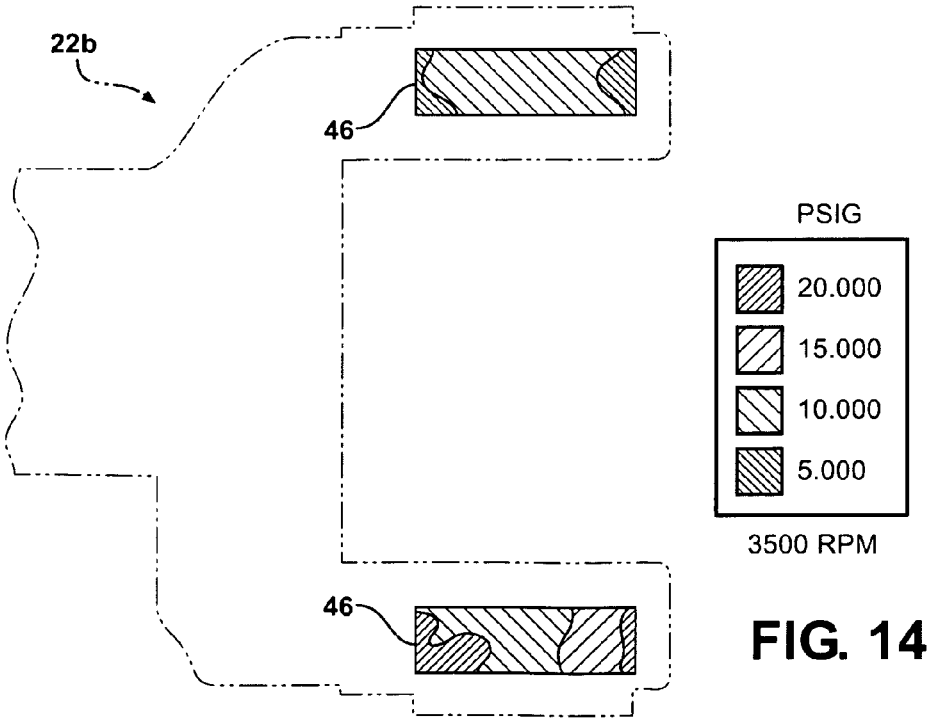
FIG. 14 is a graphical representation of fluid pressure within the first pump embodiment of FIGS. 6 and 7 as computed by a flow model of the pump operating at 3500 rpm.

Similarly, FIG. 13 displays the results of operating prior art pump 22*a* at a shaft speed of 3500 rpm while FIG. 14 displays the results of operating pump 22*b* at the same shaft speed of 3500 rpm. The pressure in the intake fluid line immediately upstream of opening 66 (FIG. 5) in prior art pump 22*a* was approximately 7 psig, whereas the pressure in the intake fluid line immediately upstream of opening 78 (FIG. 7) in first embodiment pump 22*b* was approximately 6 psig. At this lower operating speed, the intake flow channel configuration of pump 22*b* once again provides a comparatively smaller range and a more consistent and uniform distribution of pressures on vanes 46. The reduced pressure variation resulting from the intake flow channel configuration of first embodiment pump 22*b* has also been found to provide a more quietly operating pump than that resulting from the intake flow channel configuration of prior art pump 22*a*. It is also thought that the more uniform distribution of pressures generated by the intake flow channel configuration of first embodiment pump 22*b* will provide a comparatively more reliable and longer lasting pump than by that of prior art pump 22*a*.

Another aspect of the present invention provides a pump 22 modified to have a fluid communication channel to equalize pressure between terminal areas 72 and 74 of channel 64 of prior art pump 22*a*, or terminal areas 84 and 86 of channel 76 of first pump embodiment 22*b*.

Figure 16:
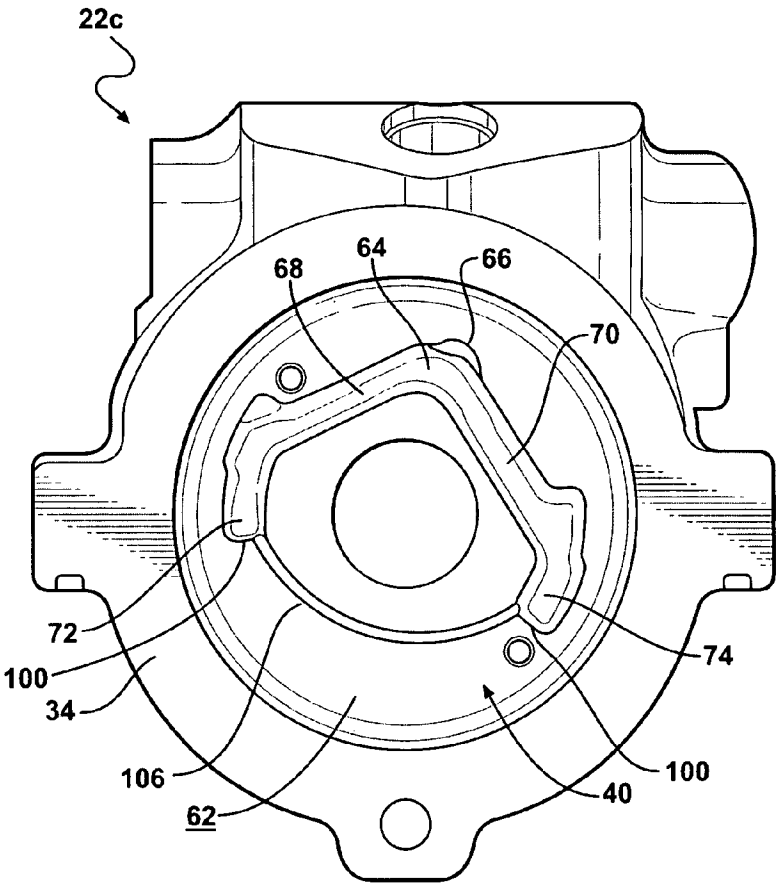
FIG. 16 is the same view as FIG. 15 but with the thrust plate removed.
Figure 15:
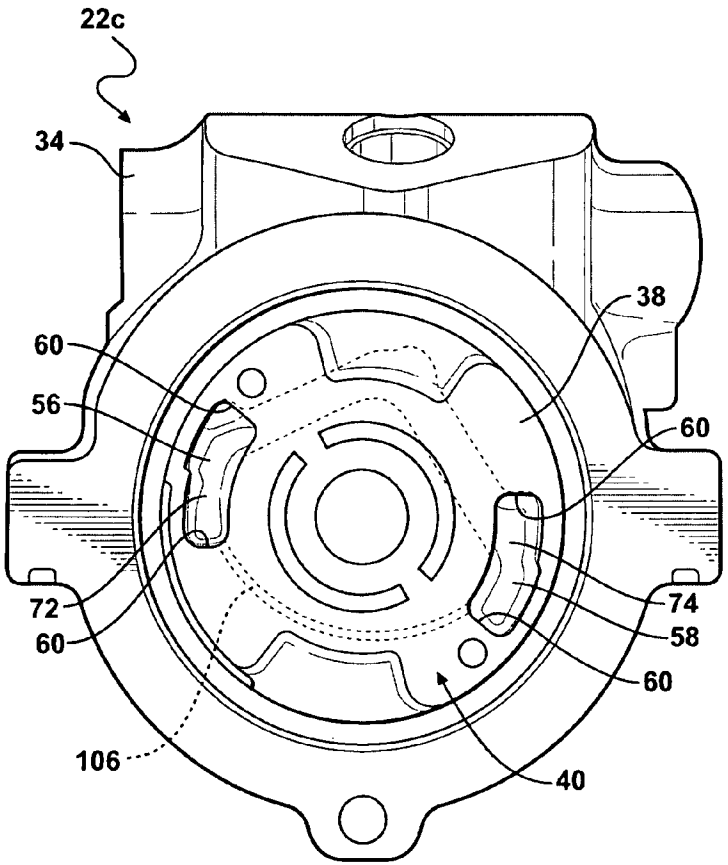
FIG. 15 is an end view of the interior housing volume of a second embodiment of a vane-type pump with the rotor removed and showing the thrust plate.

Referring to FIGS. 15 and 16, pump 22*c* is a second embodiment of pump 22 in accordance with the present invention. Pump 22*c* is substantially identical to prior art pump 22*a* except for the inclusion of fluid communication channel 106 formed in surface 62 that extends between terminal areas 72 and 74 of intake flow channel legs 68 and 70. As in prior art pump 22*a*, in second embodiment pump 22*c* fluid flows from channels 68, 70 through openings 56, 58 into intake chambers 50. In pump 22*c*, fluid is also communicated between the terminal areas of channels 68 and 70 proximate their terminal ends through groove 106.

Figure 18:
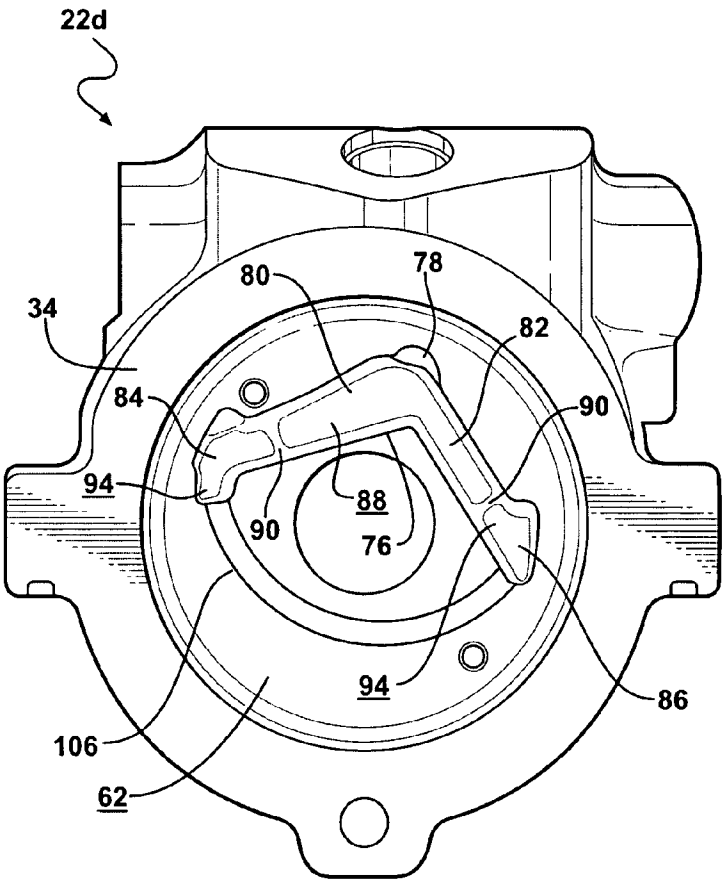
FIG. 18 is the same view as FIG. 17 but with the thrust plate removed.
Figure 17:
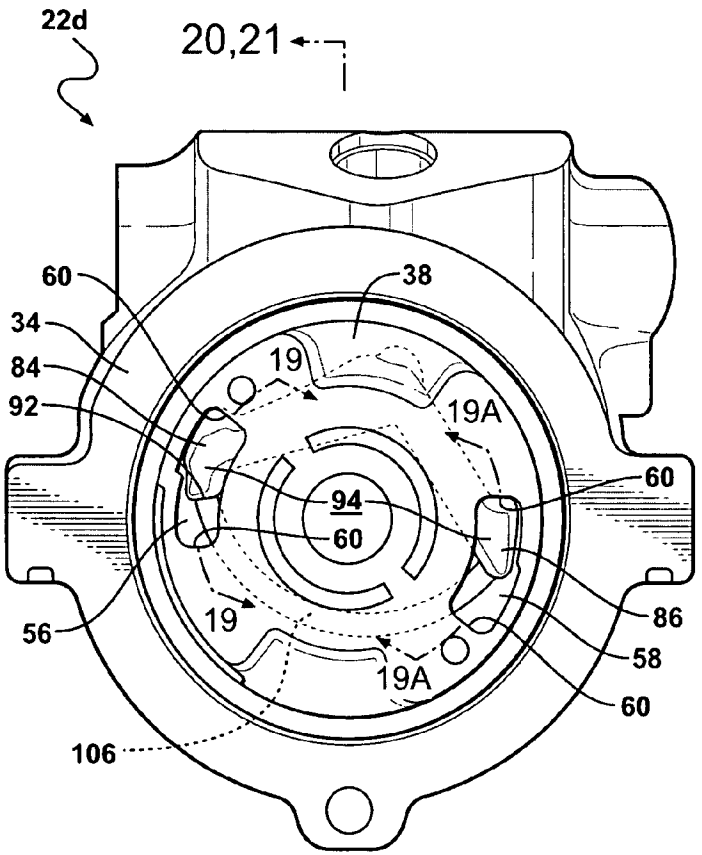
FIG. 17 is an end view of the interior housing volume of a third embodiment of a vane-type pump with the rotor removed and showing the thrust plate.
Figure 20:
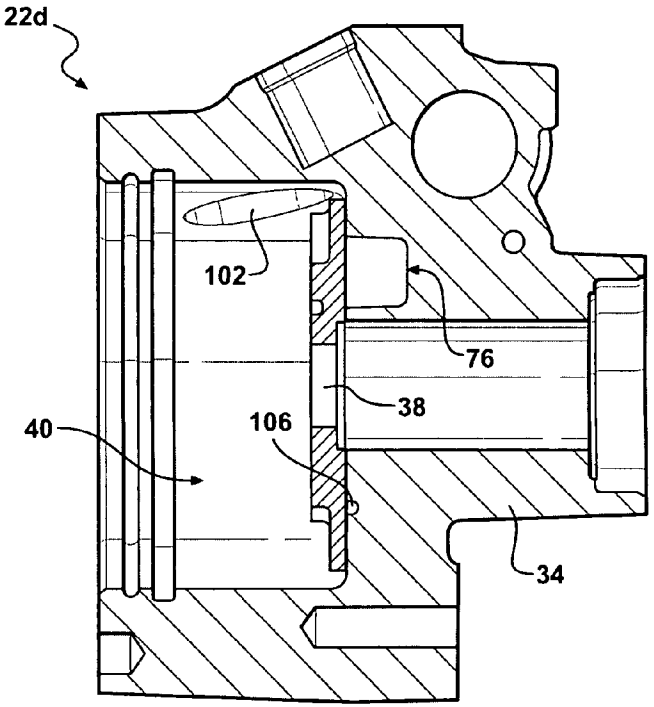
FIG. 20 is a cross sectional view taken along line 20-20 of FIG. 17.
Figure 19:
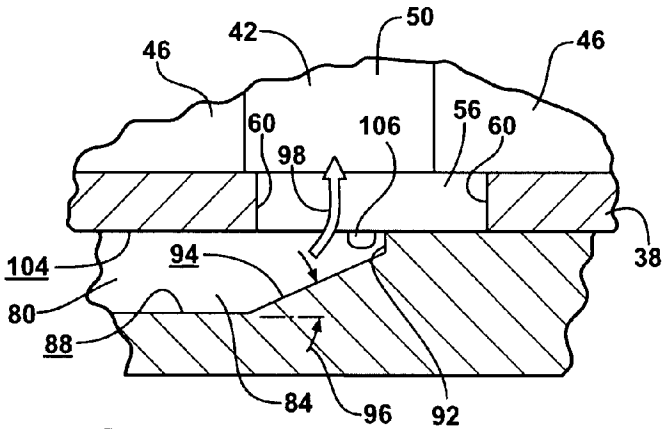
FIG. 19 is an enlarged, fragmentary view of a cross section taken along line 19-19 of FIG. 17, showing the intake flow channel, thrust plate and intake chamber.
Figure 19A:
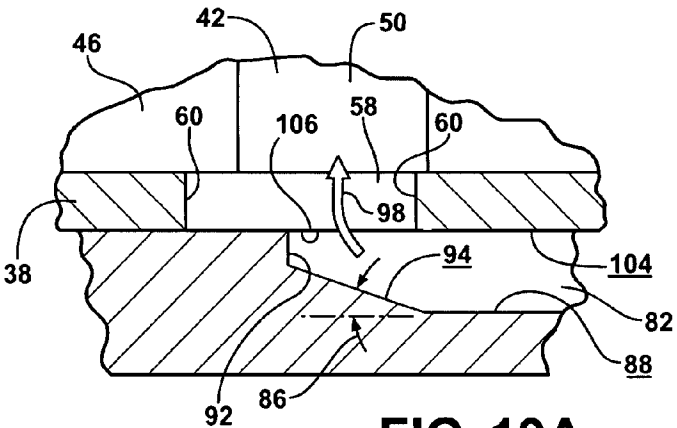
FIG. 19A is an enlarged, fragmentary view of a cross section taken along line 19A-19A of FIG. 17, showing the intake flow channel, thrust plate and intake chamber.
Figure 21:
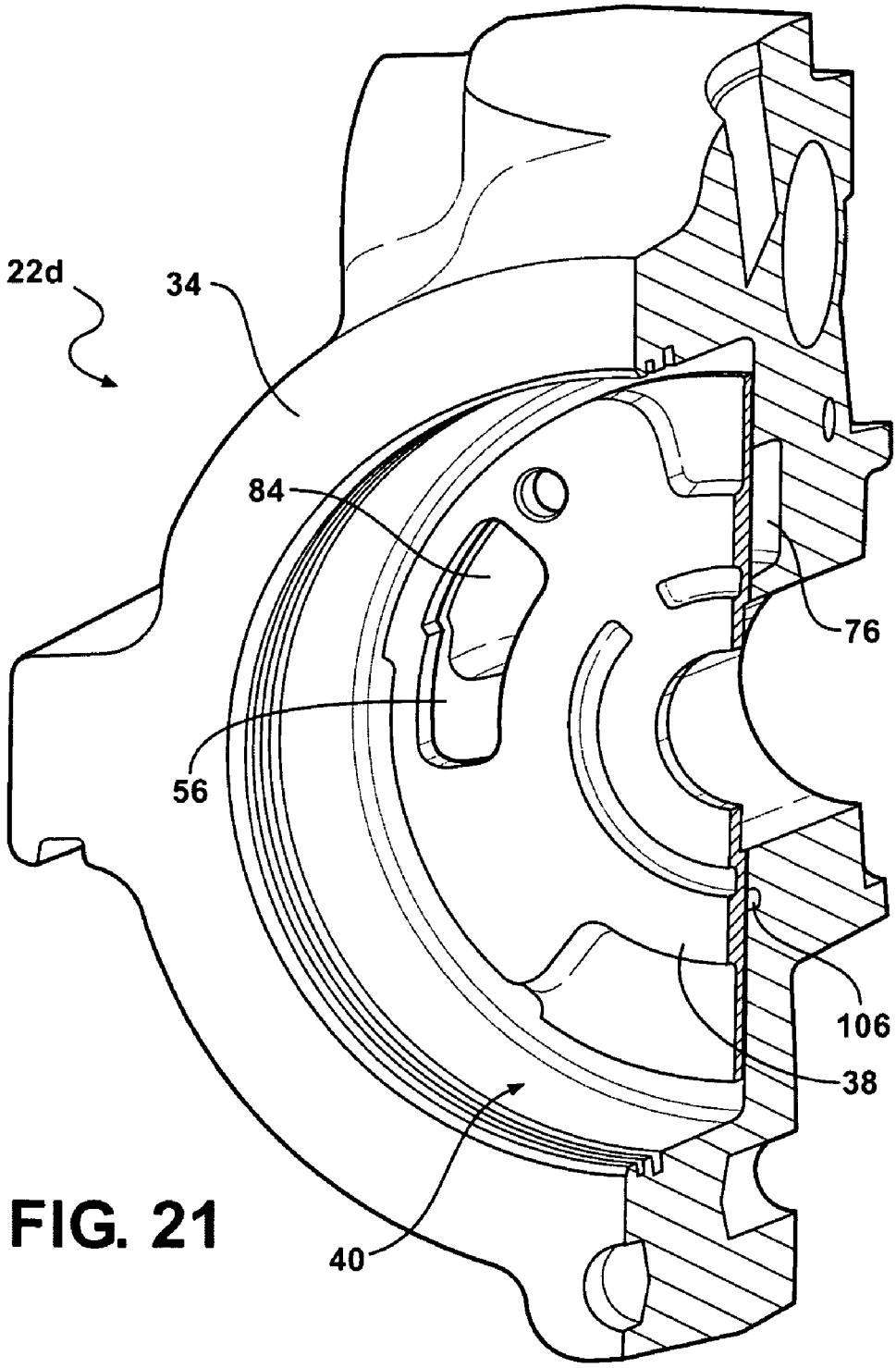
FIG. 21 is a perspective cross sectional view taken along line 21-21 of FIG. 17.

Referring to FIGS. 17 and 18, pump 22*d* is a third embodiment of pump 22 in accordance with the present invention. Pump 22*d* is substantially identical to first embodiment pump 22*b* except for the inclusion of fluid communication channel 106 in surface 62 that extends between terminal areas 84 and 86 of intake flow channel legs 80 and 82. As in first embodiment pump 22*b*, in third embodiment pump 22*d* fluid flows from channels 80, 82 through openings 56, 58 into intake chambers 50. In pump 22*d*, fluid is also communicated between the terminal areas of channels 80 and 82 proximate their terminal ends 92 through groove 106. Views of pump 22*d* shown in FIGS. 19, 19A, 20 and 21 are substantially identical to views of pump 22*b* shown in FIGS. 8, 8A, 9 and 10, with the exception of depicting groove 106 formed in surface 62.

Groove 106 acts as a pressure balancing fluid communication channel providing fluid communication between areas 72, 74 of flow channels 68, 70 in second embodiment pump 22*c*, and areas 84, 86 of flow channels 80, 82 in third embodiment pump 22*d*.In pumps 22*c* and 22*d*, groove 106 is advantageously positioned so that it communicates with the terminal areas at the point in the terminal areas where these areas experience the highest fluid pressure values, e.g., the terminal ends of such areas.

The illustrated groove 106 in pump 22*c* and pump 22*d* has a semi-circular cross-section with a depth of approximately 3 mm and a width of approximately 3.5 mm, the present invention is not, however, limited to a specific sized groove or channel 106. It is also noted that while the illustrated pressure balancing fluid communication channel 106 is formed by a groove located in surface 62 other fluid communication passages may also be employed with the present invention.

The presence of pressure balancing groove 106 tends to equalize the pressure in areas 72, 74 or 84, 86 proximate the location at which hydraulic fluid is communicated to intake chamber 50. The presence of pressure balancing groove 106 has been found to reduce the fluid pressure within the intake line. This reduction in pressure is thought to enhance the durability of the pump. It might also provide the opportunity for cost reductions through the use of a relatively thinner housing 34 and thereby providing material cost savings.

Flow model analyses of a second embodiment pump 22*c* (having pressure balancing groove 106) and a prior art pump 22*a* (otherwise identical but having no pressure balancing groove) were conducted at common operating speeds. Fluid pressure values obtained by these analyses at high compressor speeds are presented in FIGS. 22 and 23.

Figure 22:
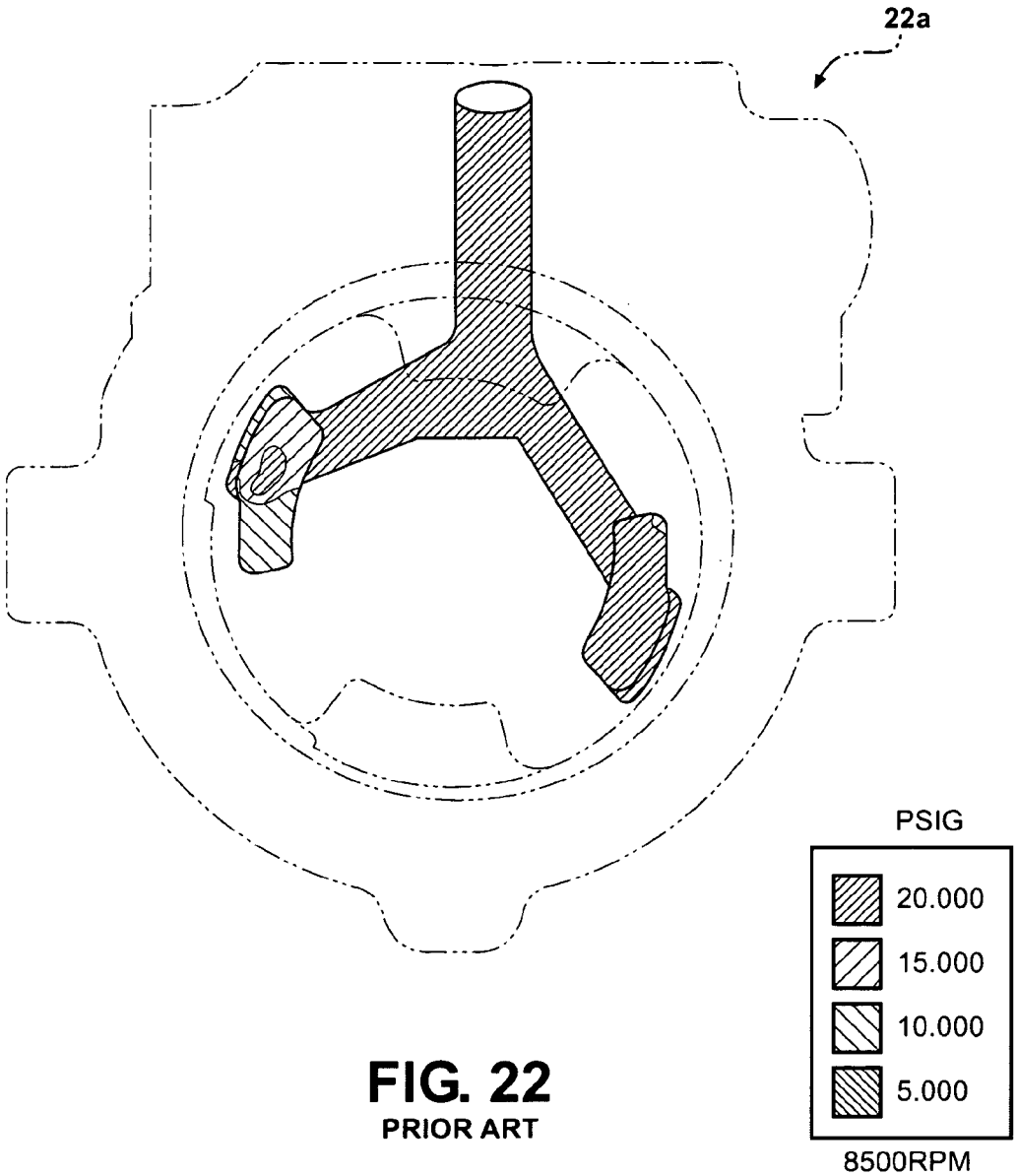
FIG. 22 PRIOR ART
FIG. 22 is a graphical representation of fluid pressure within the prior art pump of FIGS. 4 and 5, as computed by a flow model of the pump operating at a high speed.
Figure 23:
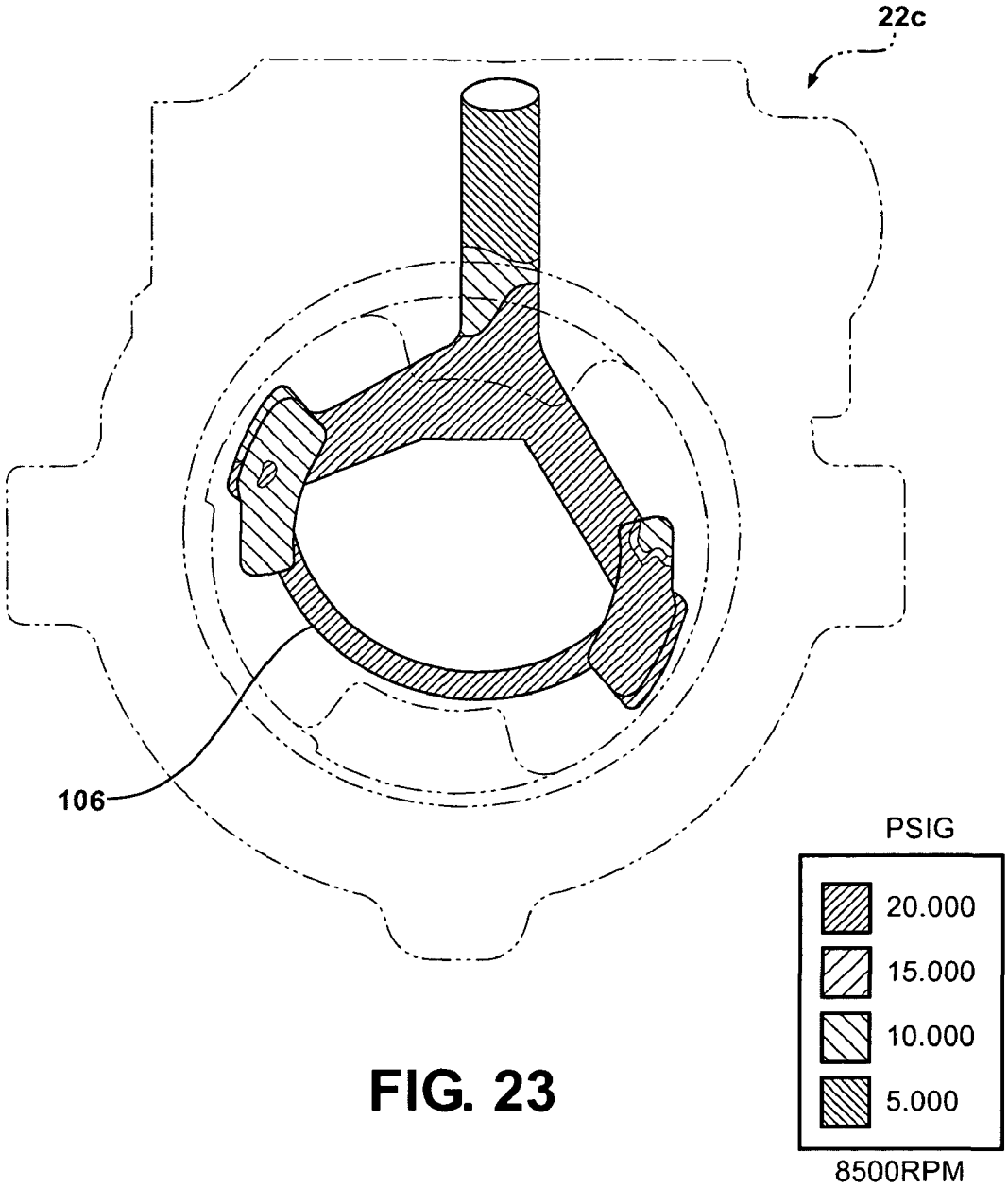
FIG. 23 is a graphical representation of fluid pressure within the second pump embodiment of FIGS. 15 and 16, as computed by a flow model of the pump operating at a high speed.

FIG. 22 displays the results of operating prior art pump 22*a* (having no pressure reducing groove) at a shaft speed of 8500 rpm, while FIG. 23 displays the results of operating second embodiment pump 22*c* (having pressure reducing groove 106) at the same shaft speed of 8500 rpm. The vertically extending rectangle located at the lower right in each of FIGS. 22 and 23 is a legend and displays the shading or cross-hatching used to represent the different, indicated pressure values in psig. The results of the analyses indicate that, under similar conditions, the pressure in the intake fluid line immediately upstream of opening 66 (FIG. 5) in prior art pump 22*a* was approximately 19.5 psig, whereas the pressure in the intake fluid line immediately upstream of opening 66 (FIG. 16) in second embodiment pump 22*c* was approximately 5.2 psig.

Similarly, the modeling results of operating prior art pump 22*a* and second embodiment pump 22*c* each at a shaft speed of 3500 rpm, while not graphically depicted herein, included the pressure in the intake fluid line immediately upstream of opening 66 (FIG. 5) in prior art pump 22*a* being approximately 7 psig, whereas the pressure in the intake fluid line immediately upstream of opening 66 (FIG. 16) in second embodiment pump 22*c* was approximately 1 psig.

While the reduction in the intake fluid pressure obtained by the use of a pressure groove 106 in second embodiment pump 22*c* or third embodiment pump 22*d* is thought to increase pump durability and longevity relative to prior art pump 22*a* or first embodiment pump 22*b*, respectively, it is also thought to relatively increase turbulence in respective terminal areas 72, 74 and 84, 86 which thereby negates some of the advantages that terminal areas 84, 86 of first embodiment pump 22*b* provides over terminal areas 72, 74 of prior art pump 22*a*.

Although the illustrated embodiments of second embodiment pump 22*c* and third embodiment pump 22*d* respectively show pressure balancing groove 106 providing fluid communication between their respective terminal areas 72, 74 and 84, 86, alternative configurations are also contemplated. For example, a pressure balancing groove 106 connect with the intake flow channels at alternative locations, or be used with much differently configured intake fluid lines.

Although the intake flow channels 64, 76 and/or pressure balancing groove 106 of the illustrated first, second and third embodiments of a pump 22 in accordance with the present invention are all formed in housing 34, alternative means of defining channels 64, 76, 106 may also be used. For example, channels 64, 76, 106 could be formed in a part that is separate from both the thrust plate 38 and housing 34, or, they could be formed in surface 104 of thrust plate 38 that faces away from chambers 50, or some combination thereof, e.g., formed by mating grooves located both in housing 34 and in surface 104 of thrust plate 38 that faces away from chambers 50.

While this invention has been described as having exemplary designs, the present invention may be further modified within the spirit and scope of this disclosure. This application is therefore intended to cover any variations, uses, or adaptations of the invention using its general principles.

What is claimed is:

1. A power steering pump, comprising:

a first surface, an intake flow channel being defined by said first surface;

a chamber into which fluid is received; and a plate disposed between said first surface and said chamber, said plate being provided with an opening extending through said plate, said plate opening having opposed terminal ends, one said terminal end being downstream of the other relative to the flow of fluid through said intake flow channel;

said intake flow channel being in fluid communication with said chamber through said plate opening;

said intake flow channel being configured to direct fluid flow through said plate opening into said chamber at a location intermediate and spaced from said terminal ends of said plate opening;

said intake flow channel being defined by a bottom surface and a sloped surface, said sloped surface extending from said bottom surface toward said plate;

wherein said intake flow channel has a transition zone through which said bottom surface and said sloped surface are joined;

wherein said transition zone is located at a position along said intake flow channel at which it and one of said plate opening terminal ends are approximately superposed.

2. A power steering pump as set forth in claim 1, comprising:

a pair of intake flow channels being defined by said first surface; and a pair of chambers into which fluid is received; and wherein said plate is disposed between said first surface and said pair of chambers, said plate being provided with a pair of openings, each said plate opening extending through said plate, each of said pair of intake flow channels being in fluid communication with one of said chambers through one of said plate openings at a location intermediate and spaced from said terminal ends of the respective said plate opening.

3. A power steering pump as set forth in claim 2, wherein a pressure balancing fluid communication channel extends between areas of said pair of intake flow channels at which said intake flow channels are respectively in fluid communication with said pair of plate openings, said areas being in fluid communication through said pressure balancing fluid channel, the pressure of fluid in the two intake flow channels at said areas being tended toward equalization through said pressure balancing fluid communication channel.

4. A power steering pump as set forth in claim 2, wherein each said plate opening is defined by opposed terminal ends, relative to each said plate opening one said terminal end being downstream of the other relative to the flow of fluid through the respective said intake flow channel.

5. A power steering pump as set forth in claim 4, wherein each said plate opening is oblong with longitudinally opposed terminal ends.

6. A power steering pump as set forth in claim 1, wherein said bottom surface and said sloped surface are both substantially planar, planes in which said bottom surface and said sloped surface lie having an angle therebetween.

7. A power steering pump as set forth in claim 6, wherein said angle is one of about 36 degrees and about 40 degrees.

8. A power steering pump as set forth in claim 1, wherein said pump is a vane-type pump and said plate is a thrust plate.

9. A power steering pump, comprising:

a first surface, an intake flow channel being defined by said first surface;

a chamber into which fluid is received; and a plate disposed between said first surface and said chamber, said plate being provided with an opening extending through said plate, said plate opening having opposed terminal ends, one said terminal end being downstream of the other relative to the flow of fluid through said intake flow channel;

said intake flow channel being in fluid communication with said chamber through said plate opening;

said intake flow channel being configured to direct fluid flow through said plate opening into said chamber at a location intermediate and spaced from said terminal ends of said plate opening;

said intake flow channel being defined by a bottom surface and a sloped surface, said sloped surface extending from said bottom surface toward said plate;

wherein said intake flow channel has a transition zone through which said bottom surface and said sloped surface are joined;

wherein said bottom surface and said sloped surface are both substantially planar, planes in which said bottom surface and said sloped surface lie having an angle therebetween;

wherein said sloped surface extends from said transition zone to a terminal end of said intake flow channel, said intake flow channel terminal end located intermediate and spaced from said terminal ends of said plate openings.

10. A power steering pump as set forth in claim 9, wherein said intake flow channel terminal end extends from said sloped surface toward said first surface.

11. A power steering pump as set forth in claim 10, wherein said intake flow channel terminal end extends between said sloped surface and said first surface a distance of about 2 mm.

12. A power steering pump, comprising:

a first surface, an intake flow channel being defined by said first surface;

a chamber into which fluid is received; and a plate disposed between said first surface and said chamber, said plate being provided with an opening extending through said plate, said plate opening having opposed terminal ends, one said terminal end being downstream of the other relative to the flow of fluid through said intake flow channel;

said intake flow channel being in fluid communication with said chamber through said plate opening;

said intake flow channel being configured to direct fluid flow through said plate opening into said chamber at a location intermediate and spaced from said terminal ends of said plate opening;

said intake flow channel being defined by a bottom surface and a sloped surface, said sloped surface extending from said bottom surface toward said plate;

wherein said plate has a surface, said plate surface being substantially parallel with said first surface, said intake flow channel being defined by said plate surface.

13. A power steering pump as set forth in claim 12, wherein at least a portion of said intake flow channel bottom surface and said plate surface are substantially parallel.

14. A power steering pump as set forth in claim 13, wherein said intake flow channel bottom surface is spaced from said plate surface a distance of about 10 mm.

* * * * *